US012767393B2

(12) United States Patent
Fan

(10) Patent No.: US 12,767,393 B2
(45) Date of Patent: Oct. 20, 2026

(54) TWIST-OPEN CAN

(71) Applicant: Shuai Fan, Ziyang City (CN)

(72) Inventor: Shuai Fan, Ziyang City (CN)

( * ) Notice: Subject to any disclaimer, the term of this patent is extended or adjusted under 35 U.S.C. 154(b) by 277 days.

(21) Appl. No.: 18/635,065

(22) Filed: Apr. 15, 2024

(65) Prior Publication Data

US 2025/0320037 A1 Oct. 16, 2025

(51) Int. Cl.
*B65D 43/02* (2006.01)

(52) U.S. Cl.
CPC ..... *B65D 43/0225* (2013.01)

(58) Field of Classification Search
CPC ..... B65D 43/0225; B65D 7/00; B65D 7/02; B65D 7/04; B65D 7/06; B65D 1/12; B65D 1/14; B65D 1/16; B65D 1/165; B65D 2517/002; B65D 17/40; B21D 51/26; B21D 51/2607; B21D 51/2615; B21D 51/2623; B21D 51/2346
USPC ..... 206/524.6; 220/62.12, 604, 606, 906, 220/605; 215/253; D9/764, 766, 767, D9/772
See application file for complete search history.

(56) References Cited

U.S. PATENT DOCUMENTS

| | | | | |
|---|---|---|---|---|
| 2,199,953 A * | 5/1940 | Hois | B65D 51/08 | 220/215 |
| 2,256,240 A * | 9/1941 | Clemons | B65D 81/2076 | 99/452 |
| 2,565,269 A * | 8/1951 | Saxton | B65D 45/24 | 292/241 |
| D318,225 S * | 7/1991 | Cassai | D9/903 | |
| 6,202,881 B1 * | 3/2001 | Chiang | B65D 17/4012 | 206/508 |
| D787,952 S * | 5/2017 | Jacober | D9/772 | |
| 2013/0200034 A1 * | 8/2013 | Kaanta | B65D 17/401 | 215/253 |

* cited by examiner

*Primary Examiner* — Javier A Pagan
(74) *Attorney, Agent, or Firm* — WPAT, PC

(57) ABSTRACT

A twist-open include a can body and a can lid. An upper end of the can body defines a filling port. The can lid is configured to seal the can body, and the can lid is fixedly connected to the can body, so that an inside of the can body is in a sealed state. A horizontal section of the can body is circular. An upper part of the can body includes a frustum part and an inverted frustum part arranged from bottom to top. An outer surface of a connection position between the frustum part and the inverted frustum part defines an indentation, and the indentation surrounds the outer surface of the connection position for one circle. The can body includes a sleeve, the sleeve is adhered to the frustum part, and the sleeve fits tightly with the inverted frustum part.

5 Claims, 2 Drawing Sheets

TWIST-OPEN CAN

TECHNICAL FIELD

The present disclosure relates to the technical field of packaging can, in particular to a novel twist-open can.

BACKGROUND

Metal packaging cans for beer and beverages have a history of more than 70 years. In the early 1930s, the United States began to produce beer metal cans. This three-piece can is made of tinplate. An upper part of the can body is conical, and a top of the can is a crown-shaped lid. A general shape of the beer metal can is not much different from that of glass bottles, so it was filled with glass bottle filling line at first. There was a dedicated filling line for the beer metal can until 1950, and the lid is changed into a flat shape in the mid-1950s and improved to an aluminum ring lid in 1960.

Most existing pop-top cans are generally used for packaging drinks or beer, but the existing pop-top cans have the following defects. Firstly, when a pop-top can is opened, its pull ring is pulled by fingernails, so the psychological experience is poor and uncomfortable for a user. Secondly, when the beverage or the beer inside the pop-top can is poured out after the pop can is opened, the beverage or the beer overflows to a periphery at the opening due to a fact that a diversion device is not arranged at the opening of the pop-top can. Thirdly, the beverage or the beer in the pop-top can is easily polluted due to a fact that a blocking device is not arranged at the opening. Fourthly, the manufacturing and assembling processes of the pull ring and a rivet of the pop-top can are relatively complicated, so that the cost of the pop-top can is increased.

SUMMARY

A purpose of the present disclosure is to solve the above technical defects. Specifically, the present disclosure provides a novel twist-open can.

To achieve the above purpose, the present disclosure provides a novel twist-open can. The twist-open can includes a can body and a can lid. An upper end of the can body defines a filling port; the can lid is configured to seal the can body, and the can lid is fixedly connected to the can body, so that an inside of the can body is in a sealed state; a horizontal section of the can body is circular; an upper part of the can body includes a frustum part and an inverted frustum part sequentially arranged in that order from bottom to top; and an outer surface of the can body at a connection position between the frustum part and the inverted frustum part defines an indentation, and the indentation surrounds the outer surface of can body at the connection position for one circle.

In an embodiment, the can body and the can lid are made of aluminum or tinplate.

In the embodiment, the can body includes a sleeve, the sleeve is adhered to the frustum part, and the sleeve fits tightly with the inverted frustum part.

In the embodiment, the twist-open can further includes reinforcing ribs, and the reinforcing ribs are disposed on an outer surface of the sleeve.

In the embodiment, the sleeve is made of a biodegradable tableware material including polypropylene (PP) and a plant fiber.

Beneficial effects of the present disclosure are as follows. In the twist-open can of the present disclosure, by setting the indentation on the outer surface of the can body at the connection position between the frustum part and the inverted frustum part, and based on a shear force generated by stress concentration and torsion, the inverted frustum part is rotated and twisted to achieve disconnection at the indentation, thereby achieving a transition from a method of opening a pop can by pulling to a method of opening the pop can by twisting. The present disclosure can solve poor and uncomfortable of psychological experience of a user caused by the user using fingernails to pull a pull ring of the pop can. At the same time, for the twist-open can, the manufacturing and assembly processes of the pull ring and rivet of the can lid are omitted, which relatively reduces the production cost.

The sleeve is sleeved on the outer surfaces of the frustum part and the inverted frustum part. The sleeve is adhered to the frustum part, and the sleeve fits tightly with the inverted frustum part. After the inverted frustum part is removed by twisting, a horn-shaped opening is defined on the can body, and the horn-shaped opening can achieve flow guidance of liquids; and meanwhile, the inverted frustum part can cover the horn-shaped opening, thereby effectively preventing the horn-shaped opening of the twist-open can from pollution.

By evenly distributing three vertical reinforcing ribs on the outer surface of the sleeve, the stiffness of the sleeve is strengthened. The sleeve can support the inverted frustum part, and the sleeve can compensate the poor strength at the connection position between the frustum part and inverted frustum part, thereby solving poor stability of the inverted frustum part caused by a curved neck structure at the connection position. Furthermore, the sleeve can compensate the poor strength at the connection position caused by the indentation defined at the connection position. The twist-open can of the present disclosure has a strong practicality, reasonable structure, convenient use, and is suitable for widespread promotion.

BRIEF DESCRIPTION OF DRAWINGS

To more clearly illustrate embodiments of the present disclosure or technical solutions in the prior art, the following will briefly introduce drawings used in the description of the embodiments or the prior art. Apparently, the drawings in the following description are only some embodiments of the present disclosure. For those of ordinary skill in the art, other drawings may also be derived from structures shown in these drawings.

DESCRIPTION OF REFERENCE NUMERALS

Figure 1:
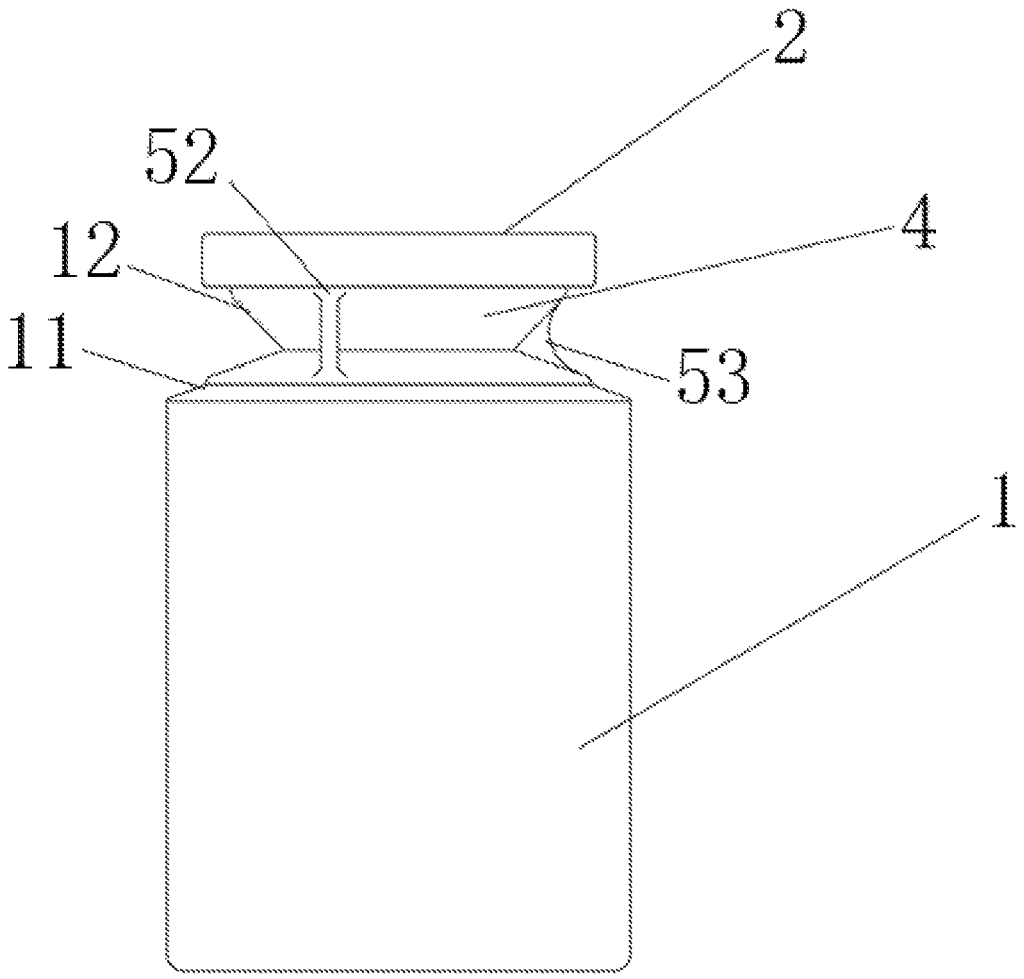
FIG. 1 illustrates a structural schematic view of a twist-open can in an embodiment of the present disclosure.

1—can body; 2—can lid; 3—indentation; 4—sleeve; 51—first reinforcing rib; 52—second reinforcing rib; 53—third reinforcing rib; 11—frustum part; 12—inverted frustum part.

The implementation, functional characteristics, and advantages of the present disclosure will be further explained based on embodiments and the drawings.

DETAILED DESCRIPTION OF EMBODIMENTS

The following will provide a clear and complete description of the technical solution in the embodiments of the present disclosure in conjunction with the attached drawings. Apparently, the described embodiments are only parts of the embodiments of the present disclosure, not all of them. Based on the embodiments in the present disclosure, all other embodiments obtained by those skilled in the art without creative work should fall within the scope of protection of the present disclosure.

It should be noted that all directional indications (such as up, down, left, right, front, and back) in the embodiments of the present disclosure are only used to explain the relative position relationship, motion situation, etc. between components in a specific posture (as shown in the attached drawings). If the specific posture changes, the directional indication also changes accordingly.

In the present disclosure, unless clearly defined and limited, the terms "connect", "fix", etc. should be understood in a broad sense, for example, "fix" can be a fixed connection, a detachable connection, or an integrated connection; it can be a mechanical connection or an electrical connection; it can be a direct connection or indirect connection achieved through an intermediate medium, it can be an internal connection between two components or an interactive relationship between two components. For those ordinary skilled in the art, the specific meanings of the above terms in the present disclosure can be understood based on specific situations.

In addition, if there are descriptions of "first", "second", etc. in the embodiments of the present disclosure, the descriptions of "first", "second", etc. are only used for a purpose of description and cannot be understood as indicating or implying their relative importance or implying the number of indicated technical features. Therefore, features limited with "first" and "second" can explicitly or implicitly include at least one of the features. In addition, the meaning of "and/or" in the present disclosure includes three parallel schemes. Taking "A and/or B" as an example, it includes scheme A, scheme B, or a scheme including both A and B. In addition, technical solutions among various embodiments can be combined with each other, but must be based on the ability of those ordinary skilled in the art to achieve. When the combination of the technical solutions conflicts or cannot be achieved, it should be considered that the combination of the technical solutions does not exist and is not within the scope of protection required by the present disclosure.

The present disclosure provides a twist-open can.

Embodiment 1

Figure 2:
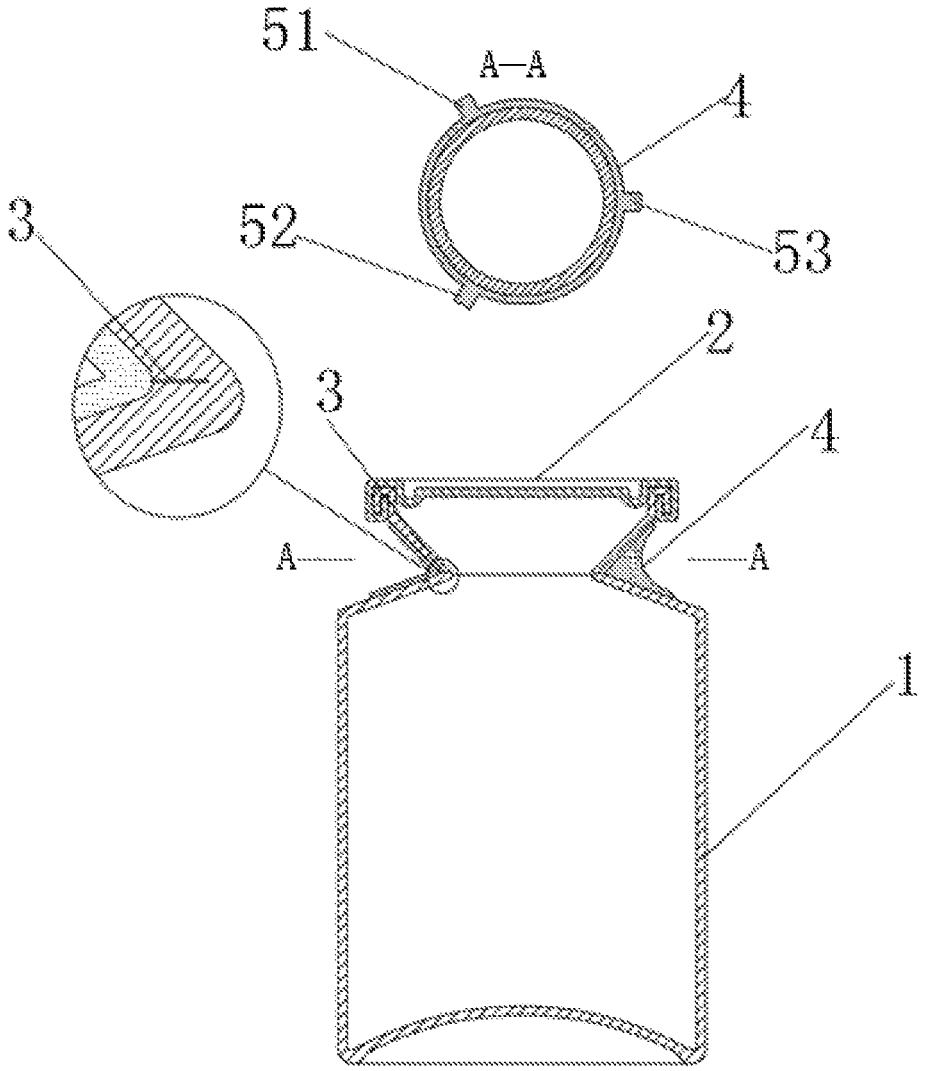
FIG. 2 illustrates a sectional view of the twist-open can in the embodiment of the present disclosure.

Referring to FIG. 1 and FIG. 2, a twist-open can is provided in the embodiment. The twist-open can includes a can body 1 and a can lid 2. An upper end of the can body 1 defines a filling port. The can lid 2 is configured to seal the can body 1, and the can lid 2 is fixedly connected to the can body 1, so that an inside of the can body 1 is in a sealed state. A horizontal section of the can body 1 is circular. An upper part of the can body 1 includes a frustum part 11 and an inverted frustum part 12 sequentially arranged in that order from bottom to top. An outer surface of the can body 1 at a connection position between the frustum part 11 and the inverted frustum part 12 defines an indentation 3, and the indentation 3 surrounds the outer surface of the can body 1 at the connection position for one circle.

In the embodiment, preferably, the can body 1 and the can lid 2 are made of aluminum or tinplate.

In the specific implementation of the twist-open can, a packaging material (for example, beer or other liquids) is filled into the can body 1, and then the can lid 2 is sealed and fixedly connected to the can body 1. When the twist-open can needs to be opened, one hand holds the can body 1, the other hand holds the can lid 2 for twisting, and the can body 1 can be broken off at the indentation 3.

In the present disclosure, by setting the indentation 3 on the outer surface of the can body 1 at the connection position between the frustum part 11 and the inverted frustum part 12, and based on a shear force generated by stress concentration and torsion, the inverted frustum part 12 is rotated and twisted to achieve disconnection at the indentation 3, thereby achieving a transition from a method of opening a pop can by pulling to a method of opening the pop can by twisting. The present disclosure can solve poor and uncomfortable of psychological experience of a user caused by the user using fingernails to pull a pull ring of the pop can.

At the same time, for the twist-open can, the manufacturing and assembly processes of the pull ring and rivet of the can lid are omitted, which relatively reduces the production cost.

Embodiment 2

Referring to FIG. 1 and FIG. 2, in the embodiment, preferably, the can body 1 further includes a sleeve 4. The sleeve 4 is adhered to the frustum part 11, and the sleeve 4 fits tightly with the inverted frustum part 12.

In the embodiment, preferably, the twist-open further includes reinforcing ribs. The reinforcing ribs are disposed on an outer surface of the sleeve 4.

In the embodiment, specifically, three vertical reinforcing ribs are evenly distributed on the outer surface of the sleeve 4, making the twist-open can more stable and safer to use.

In the embodiment, the sleeve 4 is made of a biodegradable tableware material including polypropylene (PP) and a plant fiber.

In the present disclosure, the sleeve 4 is sleeved on the outer surfaces of the frustum part 11 and the inverted frustum part 12. The inverted frustum part 12 is in contact with the can lid 2. The sleeve 4 is adhered to the frustum part 11, and the sleeve 4 fits tightly with the inverted frustum part 12. After the inverted frustum part 12 is removed by twisting, a horn-shaped opening is defined on the can body 1, and the horn-shaped opening can achieve flow guidance of liquids; and meanwhile, the inverted frustum part 12 can cover the horn-shaped opening, thereby effectively preventing the horn-shaped opening of the twist-open can from pollution.

By evenly distributing three vertical reinforcing ribs (i.e., a first reinforcing rib 51, a second reinforcing rib 52, and a third reinforcing rib 53) on the outer surface of the sleeve 4, the stiffness of the sleeve 4 is strengthened. The sleeve 4 can support the inverted frustum part 12, and the sleeve 4 can compensate the poor strength at the connection position between the frustum part 11 and inverted frustum part 12, thereby solving poor stability of the inverted frustum part 12 caused by a curved neck structure at the connection position. Furthermore, the sleeve 4 can compensate the poor strength at the connection position caused by the indentation 3 defined at the connection position.

The above embodiments are only exemplary embodiments of the present disclosure and do not limit a scope of the present disclosure. Any equivalent structural transformation made using the specification and the drawings of the present disclosure, directly or indirectly applied in other related technical fields, are included in the scope of protection of the present disclosure.

What is claimed is:

1. A can, comprising: a can body (1) and a can lid (2); wherein an upper end of the can body (1) defines a filling port; the can lid (2) is configured to seal the can body (1) and fixedly connect to the can body (1), so that an inside of the can body (1) is in a sealed state; a horizontal section of the can body (1) is circular; an upper part of the can body (1) comprises a frustum part (11) and an inverted frustum part (12) sequentially arranged in that order from bottom to top; and an outer surface of the can body (1) at a connection position between the frustum part (11) and the inverted frustum part (12) defines an indentation (3), and the indentation (3) surrounds the outer surface of the can body (1) at the connection position for one circle; and wherein the indentation (3) is positioned within a stress concentration region of the connection position, the stress concentration region is configured to concentrate stress onto the indentation (3) upon application of a manual torsional torque; and upon application of the manual torsional torque, the indentation (3) is configured to undergo shear fracture, thereby separating the can lid (2) and the inverted frustum part (12) from the can body (1).

2. The can as claimed in claim 1, wherein the can body (1) and the can lid (2) are made of aluminum or tinplate.

3. The can as claimed in claim 2, wherein the can body (1) comprises a sleeve (4), the sleeve (4) is adhered to the frustum part (11), and the sleeve (4) fits tightly with the inverted frustum part (12).

4. The can as claimed in claim 3, further comprising: reinforcing ribs; wherein the reinforcing ribs are disposed on an outer surface of the sleeve (4).

5. The can as claimed in claim 4, wherein the sleeve (4) is made of a biodegradable tableware material comprising polypropylene (PP) and a plant fiber.

* * * * *